US009818525B2

(12) United States Patent
Kim

(10) Patent No.: US 9,818,525 B2
(45) Date of Patent: Nov. 14, 2017

(54) COOLING DEVICE OF POWER TRANSFORMER

(71) Applicant: LSIS CO., LTD., Gyeonggi-do (KR)

(72) Inventor: Seong-Eon Kim, Gyeonggi-do (KR)

(73) Assignee: LSIS CO., LTD., Gyeonggi-Do (KR)

( * ) Notice: Subject to any disclaimer, the term of this patent is extended or adjusted under 35 U.S.C. 154(b) by 0 days.

(21) Appl. No.: 15/184,282

(22) Filed: Jun. 16, 2016

(65) Prior Publication Data

US 2016/0372249 A1 Dec. 22, 2016

(30) Foreign Application Priority Data

Jun. 18, 2015 (KR) ..... 10-2015-0086804

(51) Int. Cl.

| | |
|---|---|
| ***H01F 27/10*** | (2006.01) |
| ***H01F 27/08*** | (2006.01) |
| ***H01F 27/06*** | (2006.01) |
| ***H01F 27/26*** | (2006.01) |
| ***H01F 27/16*** | (2006.01) |
| ***H01F 27/22*** | (2006.01) |
| ***H01F 27/28*** | (2006.01) |
| ***H01F 27/32*** | (2006.01) |

(52) U.S. Cl.

CPC ..... *H01F 27/16* (2013.01); *H01F 27/22* (2013.01); *H01F 27/2876* (2013.01); *H01F 27/322* (2013.01)

(58) Field of Classification Search

USPC ..... 336/5, 58, 60, 65, 67, 210

See application file for complete search history.

(56) References Cited

U.S. PATENT DOCUMENTS

| | | | |
|---|---|---|---|
| 5,296,829 | A | 3/1994 | Kothmann et al. |
| 2012/0249275 | A1 | 10/2012 | Golner et al. |

FOREIGN PATENT DOCUMENTS

| | | | |
|---|---|---|---|
| CN | 202352463 | U | 7/2012 |
| DE | 19854439 | A1 | 6/2000 |
| DE | 10337153 | A1 | 3/2005 |
| EP | 2439755 | A1 | 4/2012 |
| JP | S56162810 | A | 12/1981 |
| JP | S5863110 | A | 4/1983 |
| JP | H07307227 | A | 11/1995 |
| JP | H08115823 | A | 5/1996 |
| JP | H09219327 | A | 8/1997 |
| JP | 2000-260638 | A | 9/2000 |
| JP | 2001-143937 | A | 5/2001 |
| KR | 10-0948640 | B1 | 3/2010 |
| KR | 10-2012-0051889 | A | 5/2012 |
| KR | 20-2014-0005166 | U | 10/2014 |

OTHER PUBLICATIONS

Office action dated Dec. 8, 2016 for EP corresponding application.
Chinese Office Action dated Jul. 19, 2017 corresponding to application No. 201610424166.5.

*Primary Examiner* — Ronald Hinson

(74) *Attorney, Agent, or Firm* — Nath, Goldberg & Meyer; Jerald L. Meyer; Stanley N. Protigal

(57) ABSTRACT

In some embodiments, a cooling device of a power transformer is presented and, more particularly, to a cooling device of a power transformer which may include a heat pipe and a heat sink to improve cooling performance, and to attenuate noise by eliminating a cooling fan.

7 Claims, 5 Drawing Sheets

PRIOR ART

COOLING DEVICE OF POWER TRANSFORMER

CROSS REFERENCE TO RELATED APPLICATIONS

This application claims the benefit of Korean Patent Application No. 10-2015-0086804, filed on Jun. 18, 2015, which is hereby incorporated by reference in its entirety.

BACKGROUND

1. Technical Field

The present disclosure relates to a cooling device of a power transformer and, more particularly, to a cooling device of a power transformer which is provided with a heat pipe and a heat sink to improve cooling performance, and attenuates noise by eliminating a cooling fan.

2. Description of the Related Art

In general, a power transformer is configured in a power system, and plays an important role in transmitting power supplied from a power plant to the customer side by stepping-up/stepping-down. In particular, to reduce power loss, ultra high voltage transformers are widely used.

The power transformer includes a tank called a cabinet, a bushing, and many accessory components including a conservator. In addition, a core for forming a magnetic circuit and coils wound around the core are provided in the power transformer.

An example of the power transformers described above is a hydraulic (oil) power transformer. The hydraulic power transformer is provided with a cooling duct defined by a spacer to insulate and cool the coils, and an oil (insulating oil) flowing through the cooling duct is introduced into the hydraulic power transformer.

FIG. 1 is a perspective view illustrating a support structure of a hydraulic power transformer according to the prior art. The illustrated hydraulic power transformer, which is a 3-phase power transformer, includes three coils 2 arranged on a core 1 in series. The power transformer support structure according to the prior art includes a pair of bed frames 3 disposed on a floor in parallel, a lower frame 4 placed on the bed frames 3 to be perpendicular to the bed frames 3, an upper frame 5 placed on the coils 2 in the direction of arrangement of the lower frame 4, and spacers 6 interposed between the upper and lower frames 4 and 5 and the coils 2.

When a current is applied to the power transformer to increase or decrease the voltage, heat is generated due to loss occurring in the core 1 or the coils 2. The generated heat is transferred to the insulating oil circulating through the power transformer. When the temperature in the insulating oil increases, the internal pressure of the power transformer also increases. Thereby, such overheat and increase of power may result in explosion of the power transformer and deterioration of the insulating oil, which causes damage to insulation.

To address these problems, a radiator (not shown) and cooling fan (not shown) are disposed at the exterior of the power transformer such that heat generated in the power transformer and transferred to the insulating oil is dissipated through the radiator. That is, the insulating oil circulating through a cooling duct inside the coils is sent to the radiator to discharge heat to the outside, and the insulating oil which is cooled through the radiator re-enters the cooling duct to absorb heat generated from the coils. A conventional power transformer provided with a radiator and a cooling fan as described above is disclosed in US Patent Application Publication No. 20120249275A1 (titled "Insulation for Power Transformers").

However, as cooling devices such as the radiator and cooling fan are provided to the exterior of the power transformer, the occupied space significantly increases, and loud noise occurs during operation of the cooling fan.

BRIEF SUMMARY

It is an aspect of some embodiments of the present disclosure to provide a cooling device of a power transformer which attenuates noise without causing degradation of cooling performance.

In accordance with one aspect of some embodiments of the present disclosure, a cooling device of a power transformer includes: an upper frame and a lower frame; a core installed or disposed between the upper frame and the lower frame; a coil wound around a leg portion of the core; a plurality of radial spacers formed of plates and interposed between coil sections horizontally dividing the coil; a heat pipe supported by the plurality of radial spacers and installed or disposed inside and outside the core and the coil; a heat sink coupled to an upper portion of the heat pipe and exposed to an upper portion of the coil; and a fractionating column interposed between the heat sink and the heat pipe, one end of the fractionating column being provided with one conduit and connected to the heat sink, and the other end of the fractionating column being provided with a plurality of conduits and connected to the heat pipe.

Herein, each of the radial spacers may be provided with a plurality of through holes, and the heat pipe is inserted into the through holes.

In addition, the plurality of through holes may be formed in a shape of a slit, wherein the heat pipe may include a plurality of heat pipes inserted into the through holes in parallel.

The through holes may be spaced from each other, wherein the heat pipe may include a plurality of heat pipes installed or disposed through the through holes and spaced from each other.

The cooling device may further include a plurality of axial spacers interposed between coil segments of the coil configuring sections in a radial direction.

The heat pipe may be inserted into an axial hole formed in the axial spacers.

The heat sink may be fixed to the upper frame.

The heat sink may include a plurality of heat sinks, the plurality of heat sinks being disposed circumferentially.

DETAILED DESCRIPTION

Hereinafter, embodiments of the present disclosure will be described in detail with reference to the accompanying drawings. It should be understood that the present disclosure is not limited to the following embodiments, and that the embodiments are provided for illustrative purposes only. The scope of the disclosure should be defined only by the accompanying claims and equivalents thereof.

Figure 1:
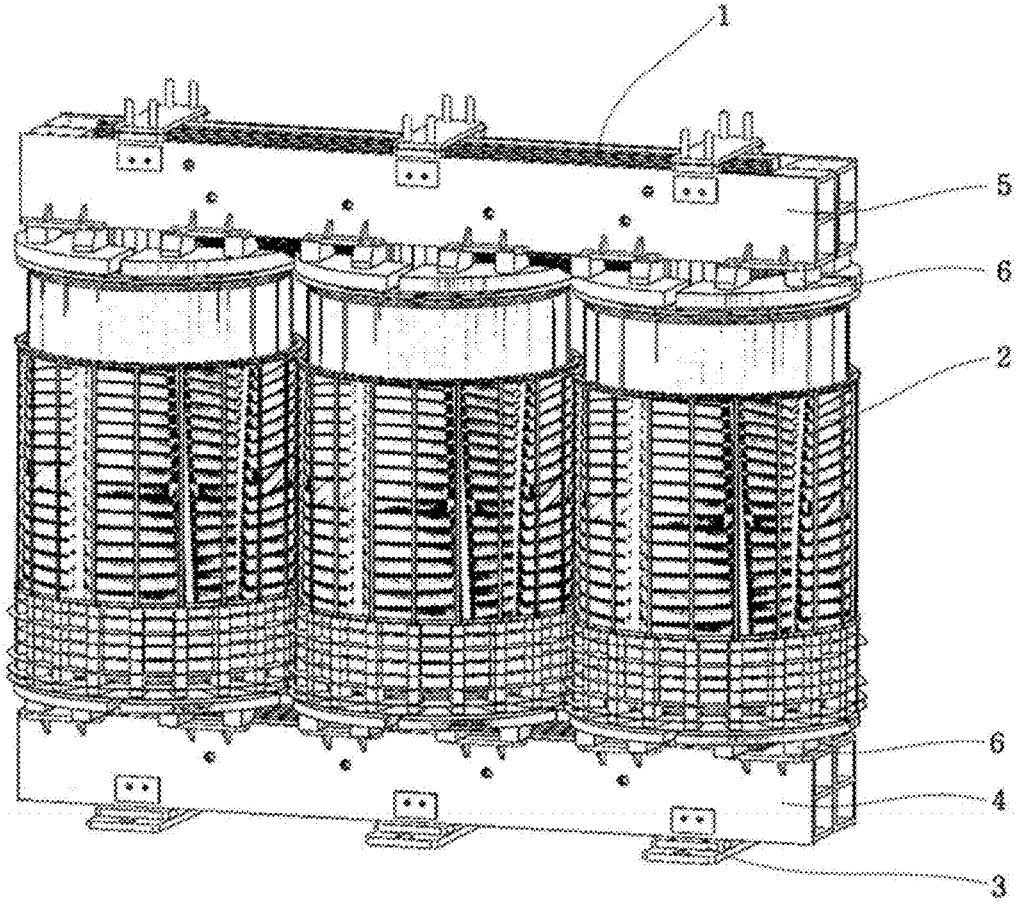
FIG. 1 is a perspective view illustrating a hydraulic power transformer according to the prior art.
Figure 2:
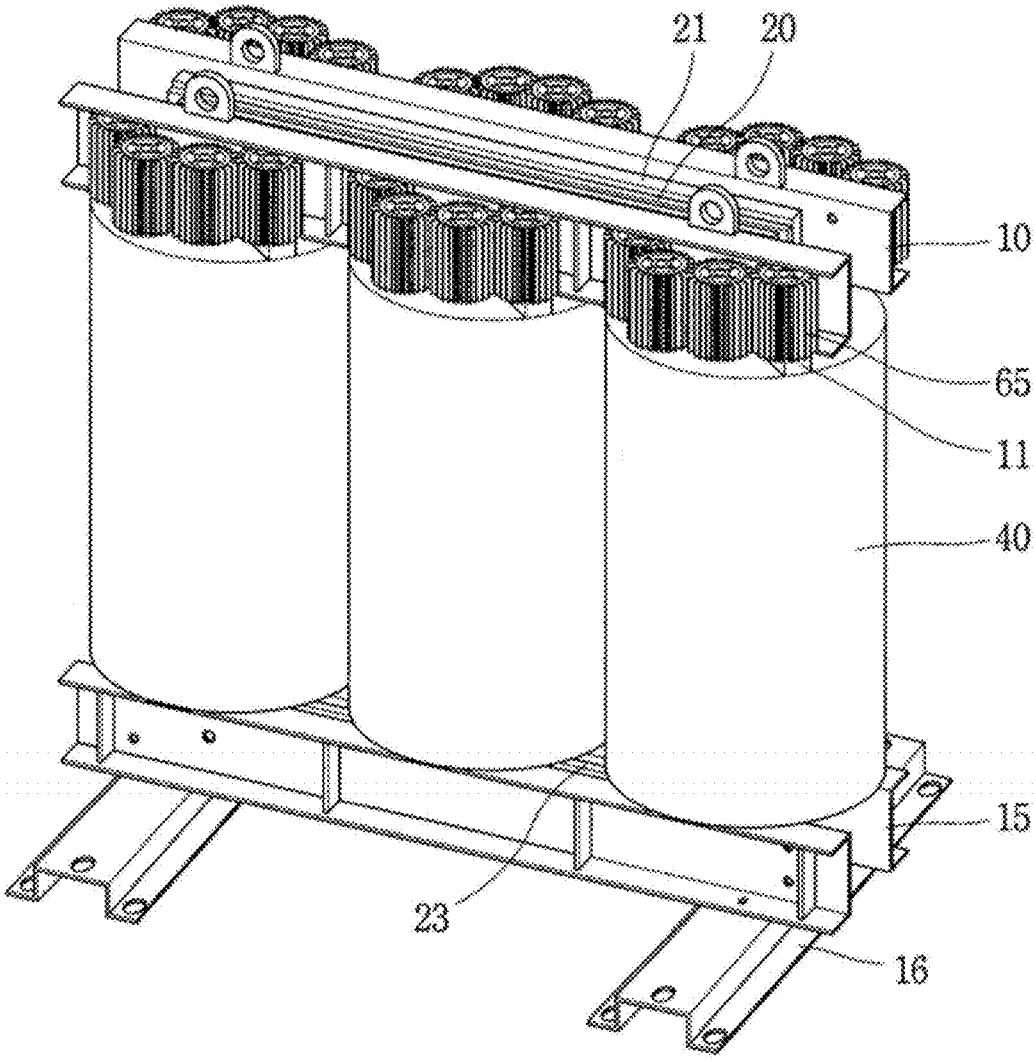
FIG. 2 is a perspective view illustrating a power transformer according to an embodiment of the present disclosure.
Figure 3:
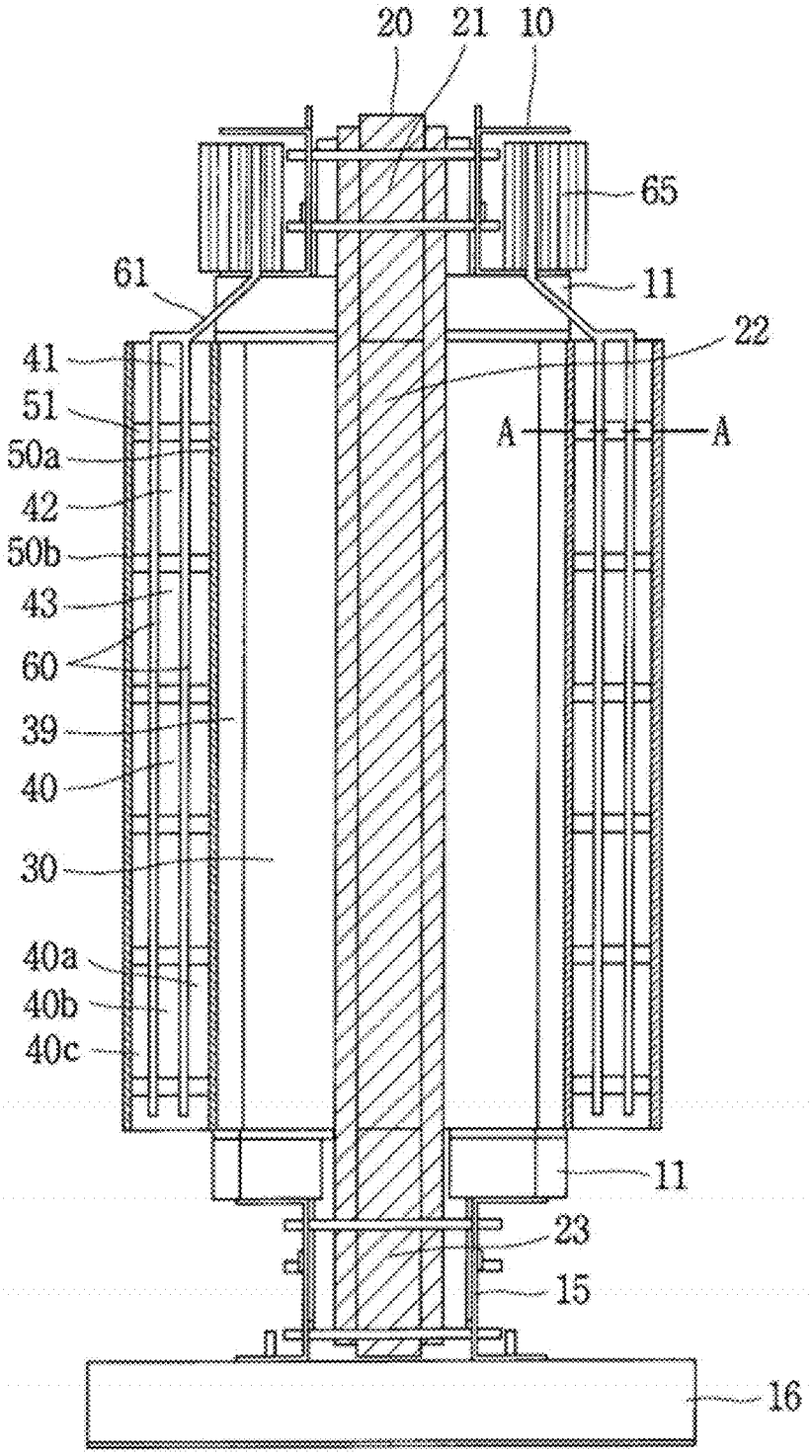
FIG. 3 is a lateral cross-sectional view illustrating a power transformer according to an embodiment of the present disclosure.
Figure 4:
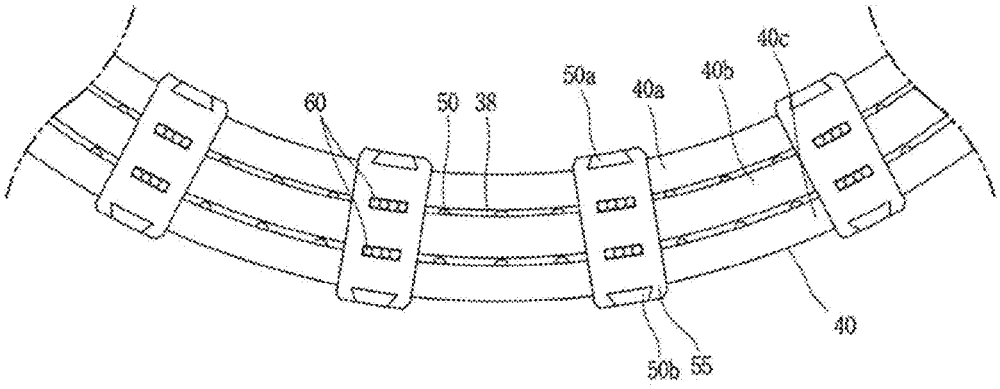
FIG. 4 is a partial cross-sectional view taken along line A-A in FIG. 3.
Figure 5:
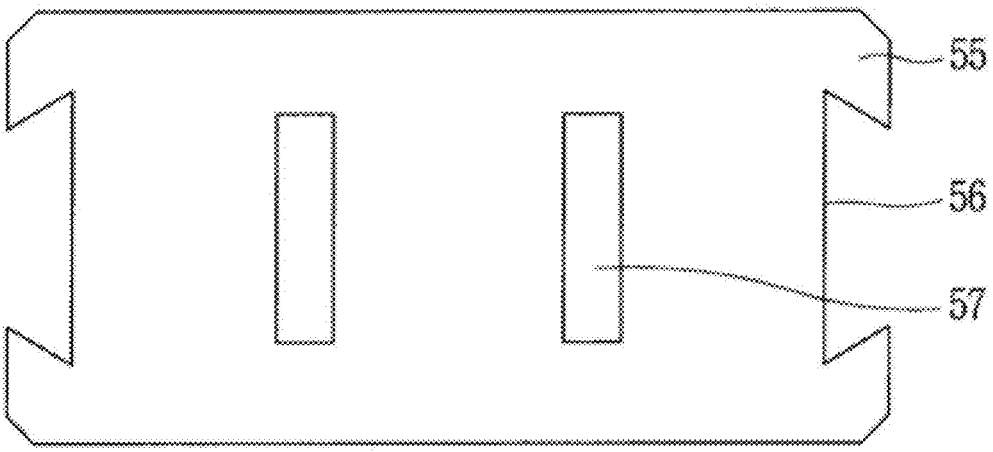
FIGS. 5 and 6 are plan views illustrating a radial spacer according to an embodiment of the present disclosure.
Figure 6:
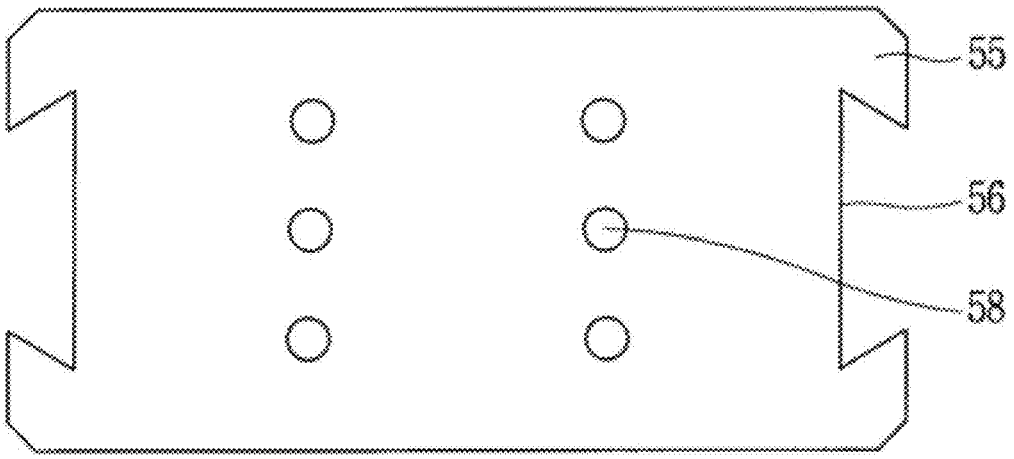

FIG. 2 is a perspective view illustrating a power transformer according to an embodiment of the present disclosure, and FIG. 3 is a lateral cross-sectional view illustrating a power transformer according to an embodiment of the present disclosure. FIG. 4 is a partial cross-sectional view taken along line A-A in FIG. 3. FIGS. 5 and 6 are plan views illustrating a radial spacer according to an embodiment of the present disclosure.

Hereinafter, a cooling device of a power transformer according to embodiments of the present disclosure will be described in detail with reference to the drawings.

According to an embodiment of the present disclosure, a cooling device of a power transformer includes an upper frame 10, a lower frame 15, a core 20 disposed between the upper frame 10 and the lower frame 15, coils 30 and 40 wound around a leg portion 22, a plurality of radial spacers 55 formed of plates and interposed between coil sections 41, 42, . . . horizontally dividing the coils 30 and 40, a heat pipe 60 supported by the radial spacers 55 and disposed inside and outside the core 20 and the coils 30 and 40, and a heat sink 65 coupled to an upper portion of the heat pipe 60 and exposed to an upper portion of the coils 30 and 40.

The lower frame 15 is disposed at the center of a base frame 16 such that the lower frame 15 is arranged perpendicular to the base frame 16. The lower frame 15 may be as long as to accommodate all the 3-phase coils.

The lower frame 15 may be formed of section shape steel.

For example, the lower frame 15 may include a pair of square bracket-shaped channels. The square bracket-shaped channels may be symmetrically disposed on the base frame 16.

The upper frame 10 is disposed at the upper portion of the coils 30 and 40 such that the upper frame 10 is arranged in the same direction as the lower frame 15.

The upper frame 10 may include a pair of square bracket-shaped channels.

The core 20 is disposed between the upper frame 10 and the lower frame 15.

The core 20 may include an upper core 21, a lower core 23, and the leg portion 22 formed between the upper core 21 and the lower core 23, wherein the upper core 21 and lower core 23 are arranged in the horizontal direction.

Herein, a plurality of leg portions 20 may be used according to the number of phases. For example, for a 3-phase circuit, three leg portions 22 may be used.

The core 20 may be seated on the base frame 16 with the upper core 21 fixedly supported by the upper frame 10 and the lower core 23 fixedly supported by the lower frame 15.

The core 20 may be formed of a material such as a grain oriented silicon steel sheet which is fabricated according to a cold rolling technique. The core 20 may be surrounded by an insulating tape including excellent thermal and mechanical properties, and anticorrosive coating may be applied to the surface of the core 20 to protect the core 20.

The coils 30 and 40 are disposed to surround the core 20.

The coils 30 and 40 may include a low voltage coil 30 and a high voltage coil 40. The coils 30 and 40 may be disposed between the upper frame 10 and the lower frame 15, and spaced from each other by a spacer 11.

The low voltage coil 30 is disposed to surround the leg portion 20.

The low voltage coil 30 may be formed by windings of a sheet conductor or line conductor. An insulation property may be provided to the surrounding of the low voltage coil 30 using, for example, a pre-preg insulated sheet.

The high voltage coil 40 is disposed outside the low voltage coil 30 to surround the low voltage coil 30, while being spaced from the low voltage coil 30.

That is, the high voltage coil 40 is formed to have an inner diameter greater than the outer diameter of the low voltage coil 30.

In this case, a cooling duct 39 may be provided between the high voltage coil 40 and the low voltage coil 30. Preferably, the high voltage coil 40 as well as the low voltage coil 30 is fabricated using a conductor including high electric conductivity.

Specifically, the low voltage coil 30 or high voltage coil 40 includes coil segments and coil sections.

Herein, the coil segments refer to arrangement of a plurality of walls in the radial direction, and the coil sections referred to arrangement of a plurality of layers in the vertical direction.

Hereinafter, the high voltage coil 40 will be described as an example. Referring to FIGS. 3 and 4, coil segments 40*a*, 40*b* and 40*c* may be formed by windings or stack of multiple coils or copper plates arranged in the form of walls. Herein, while three coil segments 40*a*, 40*b* and 40*c* are illustrated as being provided, this is simply illustrative. Any number of coil segments may be utilized.

Since a lot of heat is generated from the low voltage coil 30 or high voltage coil 40, cooling ducts 38 and 39 are provided to dissipate heat. The cooling ducts 38 and 39 are provided in the low voltage coil 30 or high voltage coil 40 and between the coil segments 40*a*, 40*b* and 40*c*. To form the cooling ducts 30 and 39, a spacer is disposed.

Axial spacers 50, 50*a* and 50*b* are provided inside and outside the low voltage coil 30 or high voltage coil 40 and between the respective coil segments 40*a*, 40*b* and 40*c*. The coil segments 40*a*, 40*b* and 40*c* are spaced from each other by the axial spacer 50, and the cooling duct 38 is formed between the neighboring coil segments 40*a*, 40*b* and 40*c*.

Herein, the axial spacers 50*a* and 50*b* disposed inside and outside the coils 30 and 40 have trapezoidal cross sections and are thus unseparably coupled to a radial spacer 55 which will be described later, to support the coils 30 and 40.

The coil segments 40*a*, 40*b* and 40*c* configure multiple sections, forming multiple layers of walls in the radial direction.

The axial spacer 50*b* at the outer edge of the coil segments 40*a*, 40*b* and 40*c* may have the same shape as the axial spacer 50*a* at the inner edge of the coil segments and be disposed such that plane symmetry is formed between the axial spacer 50*b* and the axial spacer 50*a*.

The coils 30 and 40 may be divided into coil sections 41, 42, . . . which form layers arranged in the vertical direction.

Referring to FIG. 3, the coil sections 41, 42, . . . are vertically spaced from each other by the radial spacer 55 to form layers. Groove portions 56 including a trapezoidal shape are formed on both sides of the radial spacer 55. An axial spacer 50*a* at the inner edge and an axial spacer 50*b* at the outer edge are fixedly fitted into the groove portions 56, respectively. The coil sections 41, 42, . . . are spaced from each other by the radial spacer 55 and spaces are defined between the respective coil sections 41, 42, . . . forming layers by the radial spacer 55.

The radial spacer 55 may be formed of a rectangular plate.

The groove portions 56 may be formed on both sides of the radial spacer 55 in a longitudinal direction of the radial spacer 55 such that the axial spacer 50*a* at the inner edge and the axial spacer 50*b* at the outer edge can be fixedly coupled thereto.

As shown in FIG. 5, through holes 57 into which the heat pipe 60 can be inserted is formed at the center of the radial spacer 55. Herein, the through holes 57 may be formed in the shape of slit.

The heat pipe 60 is inserted into the through holes 57 of the radial spacer 55.

The heat pipe 60 is disposed in and supported by the radial spacer 55.

A plurality of heat pipes 60 may be inserted into the through holes 57.

In this case, the heat pipes 60 may be arranged in parallel, forming a pipe bundle. As multiple heat pipes 60 are disposed in the form of a pipe bundle, heat dissipation performance may be improved.

FIG. 6 shows another embodiment of the radial spacer 55. In this embodiment, a plurality of circular through holes 58 spaced from each other is provided in the radial spacer 55. As the through holes 58 are spaced from each other, the heat pipes 60 may be arranged spaced from each other. Thereby, heat dissipation performance may be improved.

Although not shown, axial holes (not shown) may be formed in the axial spacers 50*a* and 50*b* at the inner and outer edges, and the heat pipes 60 may be inserted into the axial holes. As the heat pipes 60 are disposed in the axial spacers 50*a* and 50*b* at the inner and outer edges, cooling performance may be further improved.

Insulating oil for cooling is caused to flow through the cooling ducts 38 and 39. As the insulating oil flows upward, it may pass throughout all places where the cooling ducts 38 and 39 are formed.

When one side of a depressurized pipe containing liquid (operational fluid) such as water or alcohol is heated, the liquid is vaporized and moves to the opposite side. The vaporized fluid dissipate heat at the opposite side and changes to the liquid phase. Then, the fluid returns to the heating portion of the pipe according to a capillary phenomenon. As this procedure is implemented repeatedly, heat is transferred from the heating portion to the heat dissipation portion of the pipe. The heat pipes 60 are based on this principle. A wick, which is a core component for operation of the heat pipes, is an internal capillary structure to return the operational fluid in the liquid phase from a condenser to an evaporator. The wick has a shape of mesh or groove. The wick causes the capillary phenomenon according to surface tension of the liquid.

The heat absorption portion of the heat pipe 60 is positioned inside the coils 30 and 40, and the heat dissipation portion of the heat pipe 60 is exposed at the upper portion of the coils 30 and 40. That is, heat generated from the coils 30 and 40 moves to the upper portion of the heat pipe 60 and is then dissipated. The heat pipe 60 may formed of a material such as a copper that has a high thermal conductivity.

The heat sink 65 is coupled to the upper portion of the heat pipe 60. The heat sink 65 may be formed of a material such as aluminum that has a high thermal conductivity and is inexpensive.

The heat sink 65 may be fixedly disposed on the upper frame 10. Thereby, the heat sink 65 may be stably disposed, and thus dissipate heat from the upper frame 10 as well.

Herein, a plurality of heat sinks 65 may be provided and disposed circumferentially (see FIG. 2). The heat sinks 65 may be connected to the heat pipes 60. The heat sinks 65 may be arranged aligned with the positions of the radial spacers 55, or disposed at positions covering all the radial spacers 55.

A fractionating column 61 may be interposed between the heat sink 65 and the heat pipes 60, wherein one end of the fractionating column 61 may be provided with one conduit and connected to the heat sink 65, and the other end of the fractionating column may be provided with a plurality of conduits and connected to the heat pipes 60. Thereby, a plurality of heat pipes 60 and one heat sink 65 may be configured. Accordingly, various configurations may be designed in consideration of the limited installation area of the heat sink 65.

While an embodiment of cooling devices applied to the high voltage coil 40 has been described above, the description is also applicable to the low voltage coil 30.

Although preferred embodiments of the present disclosure have been disclosed for illustrative purposes, those skilled in the art will appreciate that various modifications, additions and substitutions are possible, without departing from the scope and spirit of the disclosure as disclosed in the accompanying claims.

What is claimed is:

1. A cooling device of a power transformer, the cooling device comprising:

an upper frame and a lower frame;

a core installed between the upper frame and the lower frame;

a coil wound around a leg portion of the core;

a plurality of radial spacers formed of plates and interposed between coil sections horizontally dividing the coil;

a heat pipe supported by the plurality of radial spacers and installed inside the coil;

a heat sink coupled to an upper portion of the heat pipe and exposed to an upper portion of the coil; and a fractionating column interposed between the heat sink and the heat pipe, one end of the fractionating column being provided with one conduit and connected to the heat sink, and the other end of the fractionating column being provided with a plurality of conduits and connected to the heat pipe, wherein each of the radial spacers is provided with a plurality of through holes, and the heat pipe is inserted into the through holes.

2. The cooling device according to claim 1, wherein the plurality of through holes is formed in a shape of a slit, and wherein the heat pipe comprises a plurality of heat pipes inserted into the through holes in parallel.

3. The cooling device according to claim 1, wherein the through holes are spaced from each other, and wherein the heat pipe comprises a plurality of heat pipes installed through the through holes and spaced from each other.

4. The cooling device according to claim 1, wherein the heat sink is fixed to the upper frame.

5. The cooling device according to claim 1, wherein the heat sink comprises a plurality of heat sinks, the plurality of heat sinks being disposed circumferentially.

6. The cooling device according to claim 1, further comprising, a plurality of axial spacers interposed between coil segments of the coil configuring sections in a radial direction.

7. The cooling device according to claim 6, wherein the heat pipe is inserted into an axial hole formed in the axial spacers.

* * * * *